US005222889A

United States Patent [19]

Hsu

[11] Patent Number: 5,222,889

[45] Date of Patent: Jun. 29, 1993

[54] ELECTRONIC IGNITER

[75] Inventor: Kun-Chung Hsu, Shin Chuang, Taiwan

[73] Assignee: Chein Sheng Machine Industrial Co., Ltd., Taipei, Taiwan

[21] Appl. No.: 925,034

[22] Filed: Aug. 5, 1992

[51] Int. Cl.[5] ..... F23Q 7/12

[52] U.S. Cl. ..... 431/255; 431/266; 431/345; 126/25 B

[58] Field of Search ..... 431/255, 345, 344, 266, 431/343, 127, 142, 143, 274, 275, 277; 126/25 B

[56] References Cited

U.S. PATENT DOCUMENTS

| | | | |
|---|---|---|---|
| 4,222,734 | 9/1980 | Nolf | 431/343 X |
| 4,305,731 | 2/1982 | Moore | 431/345 |
| 4,389,187 | 6/1983 | Sims | 431/345 |
| 4,538,983 | 9/1985 | Zeller et al. | 431/255 X |
| 4,610,624 | 9/1986 | Bruhn | 431/255 |
| 4,954,078 | 9/1990 | Nelson | 431/255 |
| 5,082,440 | 1/1992 | Yamamoto | 431/344 X |
| 5,154,601 | 10/1992 | Lloveras-Capilla | 431/345 X |

FOREIGN PATENT DOCUMENTS

| | | | |
|---|---|---|---|
| 1435657 | 5/1976 | United Kingdom | 431/255 |
| 2156499 | 10/1985 | United Kingdom | 431/255 |

*Primary Examiner*—Larry Jones

*Attorney, Agent, or Firm*—Jacobson, Price, Holman & Stern

[57] ABSTRACT

An electronic igniter which includes a spring holder to hold a gas lighter inside the housing thereof on the bottom, a metal gas nozzle having a gas inlet connected to the gas outlet of the gas lighter and a nozzle tip inserted into a hole on a metal top cover thereof spaced from a tip on the metal top cover, a piezo electronic unit having one end connected to the tip of the metal top cover and an opposite end connected to metal gas nozzle, and a control lever having an angle rod on the top stopped above the piezo electronic unit, a presser rod on the bottom stopped above the gas lever of the gas lighter, and a knob on the middle extended out of the housing. Pressing the knob of the control lever causes the piezo electronic unit to produce sparks between the nozzle tip of the gas nozzle and the tip of the metal top cap in burning the flow of fuel gas ejected through the gas nozzle.

5 Claims, 3 Drawing Sheets

ELECTRONIC IGNITER

BACKGROUND OF THE INVENTION

1. Field of the Invention

The present invention relates to an electronic igniter which uses a piezo electronic unit to release a high voltage in producing sparks between a metal gas nozzle and a metal tip on an outlet hole on the metal top cap of the housing thereof, to burn the flow of fuel gas ejected through the metal gas nozzle. A control lever is controlled to trigger the piezo electronic unit and press the gas lever of the gas lighter being held inside the housing by a spring holder. The gas nozzle is connected to the gas outlet of the gas lighter so that a flow of fuel gas is ejected through the gas nozzle as the piezo electronic unit is triggered.

2. Description of the Prior Art

The typical weather conditions are different from place to place. In the frigid zone as well as the temperate zone, the weather is severe cold during the winter. People may make a fire on a fireplace or use a hot-air stove to keep the house warm. In making a fire, a gas igniter is commonly used. A gas igniter according to the prior art is generally comprised of an elongated casing having a storage chamber on the back to keep a fuel gas, and a striker wheel on the front adjacent to the gas outlet thereof controlled to strike against a flint in producing sparks. This structure of gas igniter is not satisfactory in function because it must be regularly refilled with a fuel gas before empty. Another disadvantage of this structure of gas igniter is that it is not easy to successfully making a fire by striking the striker wheel against a flint.

SUMMARY OF THE INVENTION

The present invention provides an electronic igniter which uses a piezo electronic unit to produce sparks between two electrodes in burning up fuel gas efficiently, and a disposable cigarette lighter to release fuel gas for making a fire. Because a disposable cigarette lighter is inexpensive and can be conveniently obtained from the market, fuel supply can be conveniently provided to the electronic igniter.

DETAILED DESCRIPTION OF THE PREFERRED EMBODIMENT

Figure 1:
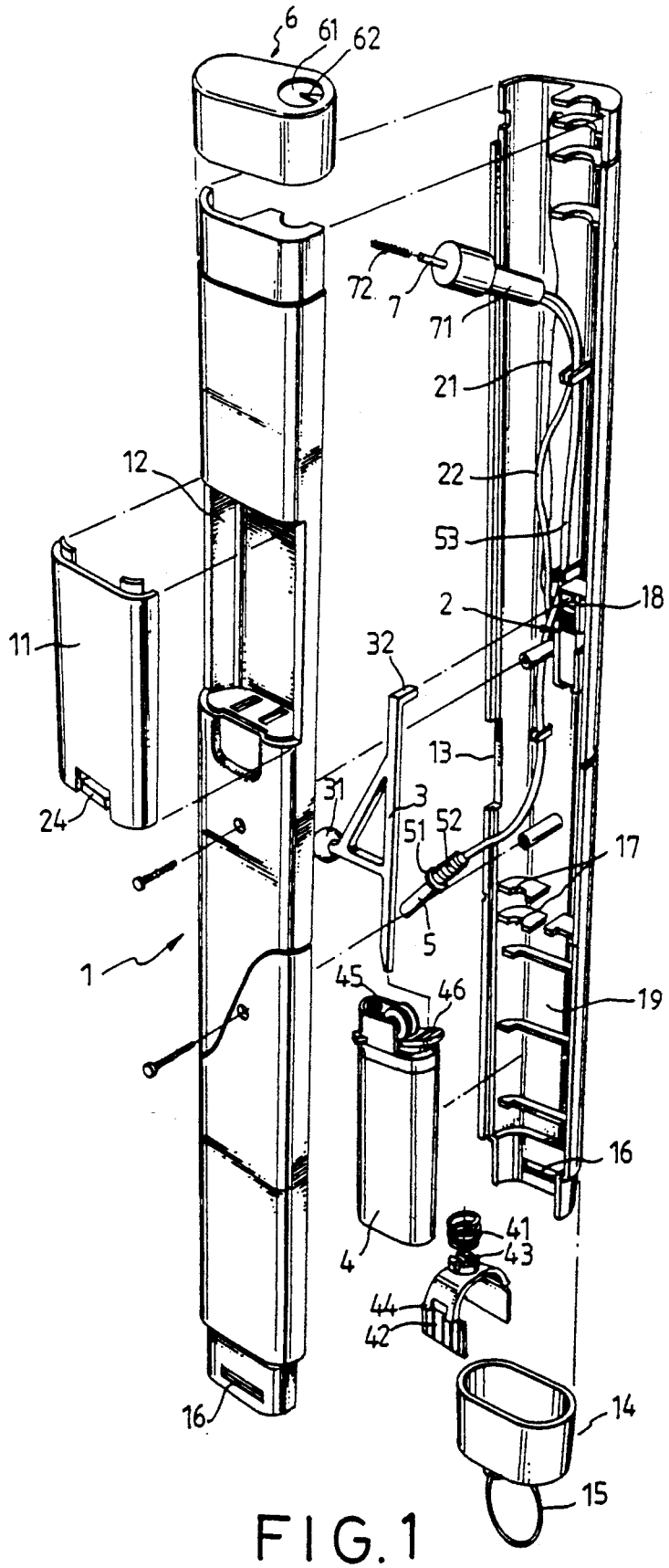
FIG. 1 is an exploded view of an electronic igniter embodying the present invention.
Figure 3:
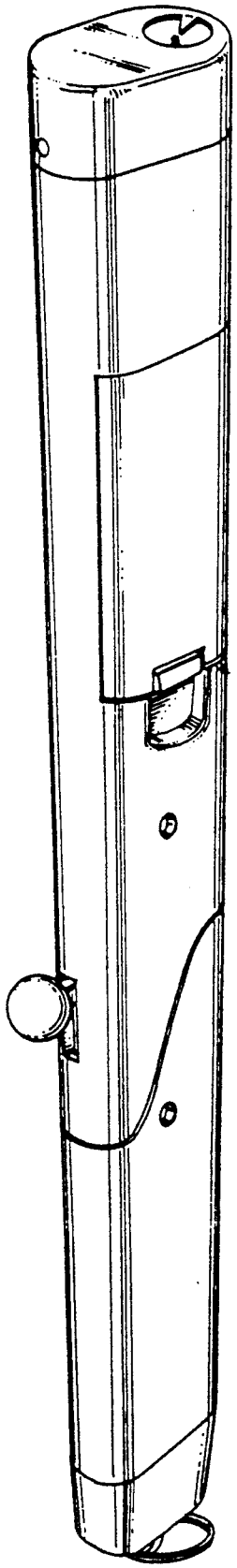
FIG. 3 is an elevational view of the electronic igniter.

Referring to FIGS. 1 and 3, an electronic igniter as constructed in accordance with the present invention is generally comprised of a housing 1, a piezo electronic unit 2, a control lever 3, a gas lighter 4, a connecting tube 5, a metal cap 6, and a gas nozzle 7.

The housing 1 of the electronic igniter is formed of two opposed halves to hold a piezo electronic unit 2 and a control lever 3. The housing 1 has an internal storage chamber 19 on the inside which receives a spring holder 42 to hold a gas lighter 4, an elongated side hole 13 through which the knob 31 of the control lever 3 projects into the outside, an external storage chamber 12 on the outside covered by a lid 11 for keeping a spare gas lighter, which lid 11 is secured to the housing 1 by a hook 24, a bottom cap 14 with hand ring 15 covered on the bottom end thereof, and a metal top cover 6 covered on the top end thereof, wherein the metal top cover 6 has a hole 61 through which a frame shoots up, and a tip 62 projecting into the hole 61; the spring holder 42 is made from an arched spring plate having a plurality of projecting strips 44 on two opposite sides inserted into respective holes 16 on the inside wall of the housing 1 for positioning, a top tenon 43, and a spring coil 41 mounted on the top tenon 43 to support the gas lighter 4 in place. The gas lighter 4 can be a disposable cigarette lighter having a gas outlet 45 coupled to a connecting tube 5. The connecting tube 5 comprises a collar 51 to hold a spring coil 52. The spring coil 52 has one end stopped against the collar 51 on the connecting tube 5 and an opposite end stopped against two opposite locating plates 17 on the inside wall of the housing. The spring coil 52 constantly gives a pressure to the collar 51 in holding down the connecting tube 5, causing the connecting tube 5 to be airtightly connected to the gas outlet 45 of the gas lighter 4. The connecting tube 5 has an opposite end connected to a flexible gas tube 53, which delivers fuel gas from the gas lighter 4 to a gas nozzle 7 inside the hole 61 on the metal top cover 6.

The piezo electronic unit 2 and the control lever 3 are received inside the housing 1. The control lever 3 has a knob 31 on the middle extended out of the housing 1 through the elongated side hole 13 for triggering control with the fingers, a bottom end stopped at the gas lever 46 of the gas lighter 4 and controlled to let fuel gas flows out of the gas outlet 45, and a top end formed into an angle rod 32 stopped at the piezo electronic unit 2 on the top. The piezo electronic unit 2 is fastened inside a recessed hole 18 on the inside of the housing 1. The piezo electronic unit 2 has one end connected to the metal top cap 6 by a first electric wire 21, and an opposite end connected to the gas nozzle 7 by a second electric wire 22. The gas nozzle 7 is made from an electric conductive material having a gas inlet (not shown) on one end coupled with the flexible gas tube 53 and the second electric wire 22 covered with an insulator 71, and a nozzle tip (not indicated) on an opposite end sleeved with a spring coil 72. The spring coil 72 lessens shock waves while fuel gas ejects out through the gas nozzle 7, permitting fuel gas to be well mixed with air for complete combustion.

Figure 2:
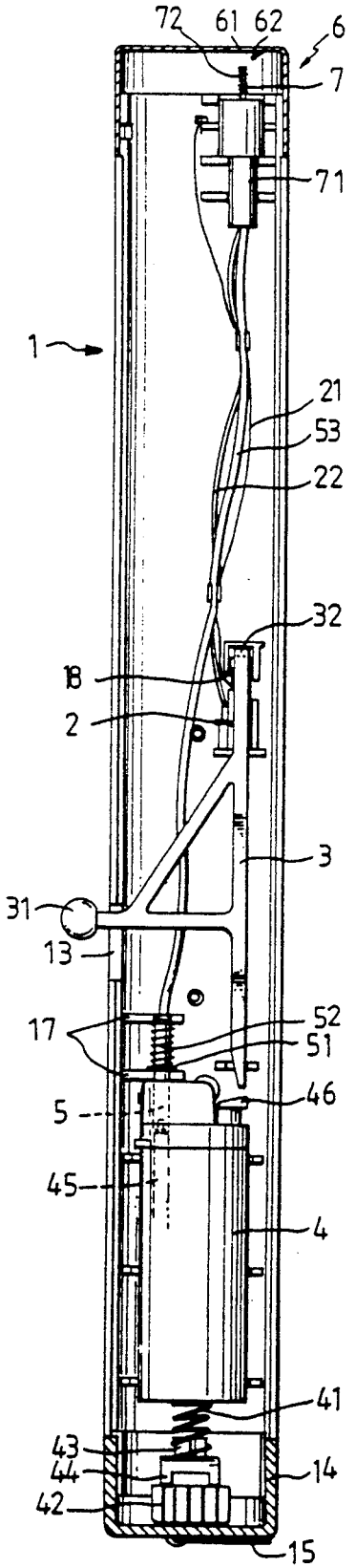
FIG. 2 is a sectional view of the electronic igniter taken in longitudinal direction.

Referring to FIG. 2, pressing the knob 31 causes the gas lever 46 to be moved downwards, and therefore fuel gas is allowed to flow out of the gas nozzle 7 through the connecting tube 5 and the flexible gas tube 53. At the same time, the piezo electronic unit 2 is triggered by the angle rod 32 to produce a high voltage causing sparks to be produced between the tip 62 (side electrode) and the nozzle 7 (central electrode) in burning fuel gas. The gas lighter 4 is a disposable flint type cigarette lighter that is in inexpensive and can be conveniently obtained from the market. A spare gas lighter may be kept in the external storage chamber 12 for future use.

What is claimed is:

1. An electronic igniter comprising a housing to hold a control lever, a piezo electronic unit and a gas lighter, and characterized in that said housing is covered with a metal top cap on the top and a bottom cap on the bottom, and comprises a recessed hole on the inside to hold said piezo electronic unit, a spring holder fastened in a bottom chamber covered by said bottom cap to hold said gas lighter, two locating plates above said bottom chamber to hold a connecting tube, said connecting tube having one end connected to the gas outlet of said gas lighter and an opposite end connected to a metal gas nozzle by a gas tube, said metal top cap having a tip projecting into an outlet hold thereon, said control lever having a knob on the middle extended out of said housing through a sliding hole, an angle rod on the top stopped at said piezo electronic unit on the top, and a presser rod on the bottom stopped at the gas lever of said gas lighter, said gas nozzle having a gas inlet on one end coupled with said gas tube and said second electric wire covered with an insulator, and an conductive nozzle tip on an opposite end sleeved with a spring coil and inserted into the hole on said metal top cap spaced from the tip of said metal top cap; pressing the knob of said control lever causes said gas lighter to eject a flow of fuel gas through said gas nozzle, and simultaneously causes said piezo electronic unit to produce sparks between the tip of said metal top cap and the nozzle tip of said gas nozzle in burning the flow of fuel gas.

2. The electronic igniter according to claim 1, wherein said spring holder is made from an arched spring plate having a plurality of projecting strips on two opposite sides inserted into respective holes on said housing, a top tenon, and a spring mounted on said top tenon to support said gas lighter.

3. The electronic igniter according to claim 1, wherein said connecting tube comprises a collar to hold a spring coil stopped below said two locating plates.

4. The electronic igniter according to claim 1, wherein said piezo electronic unit is stopped below said control lever and has two opposite ends respectively connected to said metal top cap and said metal gas nozzle by wires.

5. The electronic igniter according to claim 1, wherein said housing comprises an external storage chamber on the outside for keeping a spare gas igniter, said external storage chamber being covered with a lid through a hooked joint.

* * * * *